US005142896A

United States Patent [19]

Berger et al.

[11] Patent Number: 5,142,896

[45] Date of Patent: Sep. 1, 1992

[54] CLUSTER MILL WITH HYDRAULIC SCREW-DOWN

[75] Inventors: Bernd Berger, Kaarst; Peter Reinthal, Hemer, both of Fed. Rep. of Germany

[73] Assignee: Sundwiger Eisenhutte Maschinenfabrik, Hemer, Fed. Rep. of Germany

[21] Appl. No.: 614,100

[22] Filed: Nov. 15, 1990

[30] Foreign Application Priority Data

Nov. 25, 1989 [DE] Fed. Rep. of Germany ..... 3939124

[51] Int. Cl.[5] ..... B21B 31/22; B21B 31/32

[52] U.S. Cl. ..... 72/242.4; 72/245; 72/248

[58] Field of Search ..... 72/242.4, 243.4, 244, 72/245, 248

[56] References Cited

U.S. PATENT DOCUMENTS

| | | | |
|---|---|---|---|
| 3,076,360 | 2/1963 | Sendzimir | 72/242.4 |
| 3,169,423 | 2/1965 | Sims | 72/242.4 |
| 3,464,245 | 9/1969 | Dowsing et al. | 72/248 |
| 3,852,984 | 12/1974 | Greenberger | 72/245 |
| 3,858,424 | 1/1975 | Kajiwara et al. | 72/242.4 |
| 3,878,703 | 4/1975 | Mills et al. | 72/245 |
| 4,380,921 | 4/1983 | Matsui | 72/163 |

FOREIGN PATENT DOCUMENTS

| | | | |
|---|---|---|---|
| 1902555 | 8/1970 | Fed. Rep. of Germany . | |
| 1939181 | 2/1971 | Fed. Rep. of Germany | 72/242.4 |
| 1752345 | 11/1971 | Fed. Rep. of Germany . | |
| 2307856 | 8/1974 | Fed. Rep. of Germany . | |
| 2652325 | 5/1978 | Fed. Rep. of Germany | 72/248 |
| 2726140 | 12/1978 | Fed. Rep. of Germany . | |
| 8403103 | 7/1984 | Fed. Rep. of Germany . | |
| 0002174 | 5/1962 | Japan | 72/206 |
| 0158209 | 12/1981 | Japan | 72/242.4 |
| 1316580 | 5/1973 | United Kingdom . | |

*Primary Examiner*—Lowell A. Larson
*Assistant Examiner*—Thomas C. Schoeffler
*Attorney, Agent, or Firm*—Marmorek, Guttman & Rubenstein

[57] ABSTRACT

The invention relates to a cluster mill having four columns 5, 6 connecting the lower part 1 and the upper part 2 for the sets of rolls 3, 4. Associated with each column 5, 6 is a lifting device 11, 12 enabling the lower part 1 and the upper part 2 to be moved wide apart. A hydraulic roll screw-down system independent thereof has an adjustable piston 16 which can be attached to the column 5, 6 and between which and the bottom of its cylinder casing 17 borne by the upper part 2 the necessary roll force can be built up. Due to the adjustable piston 16, for any required roll gap the cylinder space in which the pressure for the roll force is built up has a low height.

5 Claims, 2 Drawing Sheets

CLUSTER MILL WITH HYDRAULIC SCREW-DOWN

The invention relates to a cluster mill having a lower part receiving the lower set of rolls, an upper part receiving the upper set of rolls, and four columns which are disposed between the lower part and the upper part and are anchored more particularly in the lower part and on which the upper part is guided and against each of which a hydraulic screw-down system for the roll force bears.

In a prior art cluster mill of the kind specified (German Utility Model 84 03 103) each column has fixed thereon a piston which can be acted upon on both sides. By acting on the pistons it is possible on the one hand to raise and lower the upper part, and on the other to exert the required roll force. The maximum stroke of the cylinder-and-piston units is determined by that zone of the thickness of the rolling stock which is to be covered. This means that in the case of thick rolling stock there is a small unobstructed height of the cylinder space of the cylinder-and-piston units in which hydraulic pressure for the roll force is present, while in the case of thin rolling stock said height is large. However, a large height of the cylinder space is unfavourable for rolling, since due to the large volume of the cylinder space the upper part yields resiliently with high roll forces. Attempts are therefore made to keep the height of the cylinder space as small as possible. However, small heights not only limit the thickness range of the rolling stock, but are also a disadvantage when the stock is introduced into the roll gap and in other operations for which as large a passage aperture in the roll stand as possible is advantageous.

It is an object of the invention to provide a cluster mill whose sets of rollers can on the one hand be moved apart as far as possible and whose hydraulic screw-down system on the other hand is as rigid as possible during rolling operation.

In a cluster mill of the kind specified this problem is solved according to the invention by the features that associated with each column is a lifting device independent of the hydraulic screw-down system and operative between the lower part and the upper part, each hydraulic screw-down system having a piston which can be adjusted in the lifting direction and can be axially attached in a given position to the column and between which and the bottom of its cylinder casing borne via the upper part the hydraulic pressure for the roll force can be built up.

The separation between the parts required for the adjustment of the roll force and the parts required for moving the sets of rolls apart on the one hand enables the roll stand to be opened wide, so that part of a strip can be introduced without problems, or scrap can readily be removed if the strip cracks, or roll interchange can be readily performed, while on the other hand a small height of the operative cylinder space provided for hydraulic adjustment is obtained for a wide range of adjustment of the required roll gap.

The means by which the piston is fixed to the column to allow for different widths of roll gap can be designed in various ways.

In a first alternative the piston is axially attached to a spindle which is screwed into the column and can be axially adjusted by means of an adjusting member. With this design, therefore, the piston can be steplessly positioned mechanically.

In a second alternative the piston can be acted upon on both sides and can be fixed on a stop of the column by acting upon the side not required for the screw-down system. Spacing and adjusting elements can be inserted between the stop and the piston for adjustment to different roll gaps.

Two embodiments of the invention will now be explained in greater detail with reference to the drawings, wherein.

To simplify the description, in the two embodiments like elements have like references.

Figure 1:
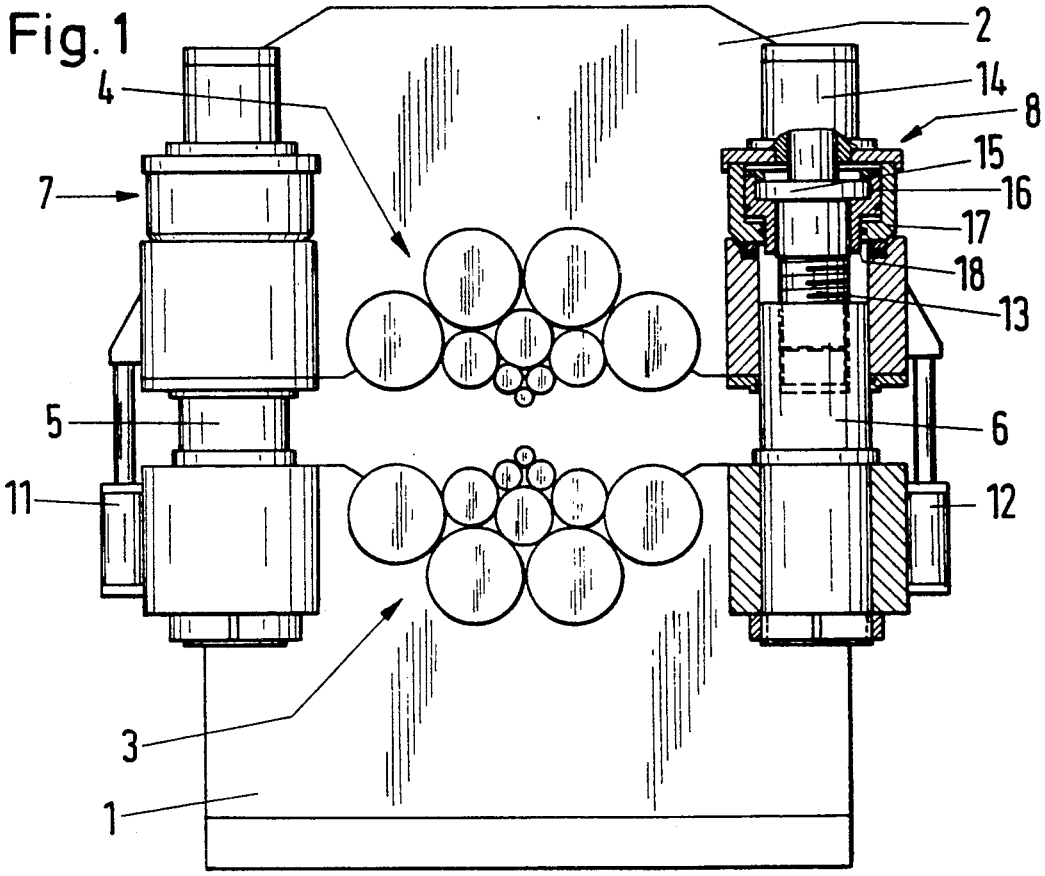
FIG. 1 is a partially axially sectioned side elevation of a cluster mill with the sets of rollers moved apart.

Each of the two cluster mills comprises a lower part 1 and an upper part 2 each of which receives a set of rollers 3, 4, two pairs of columns 5, 6 being provided on each side of the stand. Associated with each column 5, 6 is a hydraulic system 7, 8; 9, 10 which is differently constructed in the two embodiments. A hydraulic or mechanical lifting device 11, 12 is associated with each column 5, 6 between the lower part 1 and the upper part 2. By raising the upper part 2 by means of the lifting device 11, 12 the sets of rollers 3, 4 can be moved apart, as shown in FIGS. 1 and 3.

Figure 2:
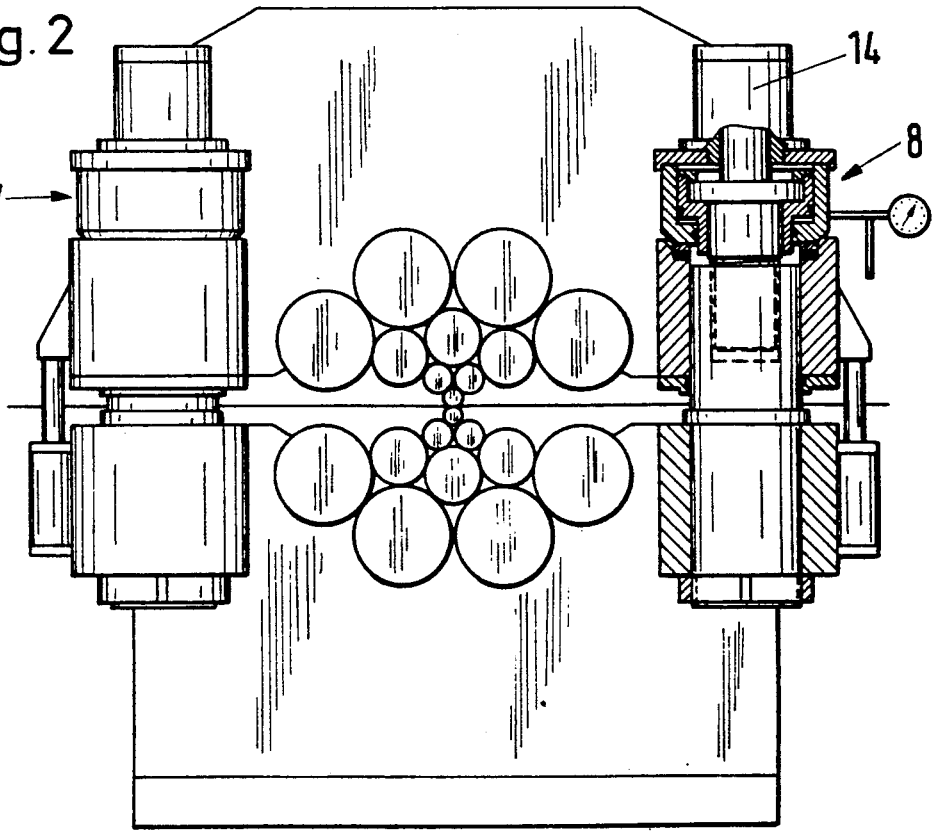
FIG. 2 shows the cluster mill shown in FIG. 1 with the sets of rollers moved together during rolling operation.

In the embodiment illustrated in FIGS. 1 and 2 an axial spindle 13 is screwed into the column 6. The spindle 13 can be rotated and therefore axially adjusted by means of an adjusting member 14 taking the form of an adjusting motor. The spindle 13 bears an annular collar 15 on which a piston 16 is fixed axially. The piston 16 is disposed secured against rotation in a cylinder casing 17. A cylinder space to which the pressure medium for the hydraulic adjustment of the roll force can be supplied is disposed between the underside of the piston 16 and an inwardly pointing collar 18 of the cylinder casing 17.

The lifting devices 11, 12 are actuated to move the upper part 2 out of the position shown in FIG. 1, in which, for example, the start of the strip can be readily introduced due to the large distance between the working rolls, into the operating position shown in FIG. 2. At the same time the adjusting member 14 is switched on, so that the upper part 2 can be lowered. After the position shown in FIG. 2 has been reached, the pressure medium for building up the roll force is introduced into the cylinder space between the piston 16 and the collar 18 of the cylinder casing 17. As the drawings show, the unobstructed height of the cylinder space is very small, so that not much pressure medium is required, with the consequence that the adjusted roll force is highly rigid.

Figure 3:
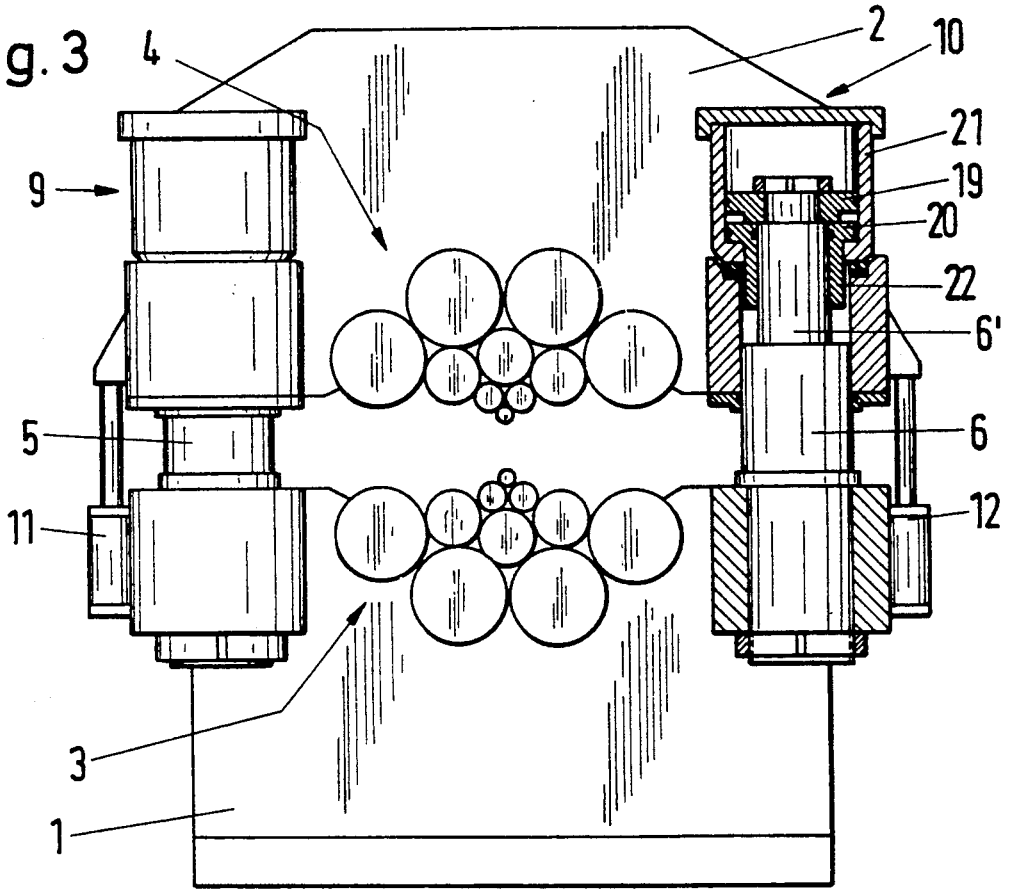
FIG. 3 is a partially axially sectioned side elevation of a cluster mill with sets of rollers moved apart, in a variant embodiment of FIGS. 1 and 2.
Figure 4:
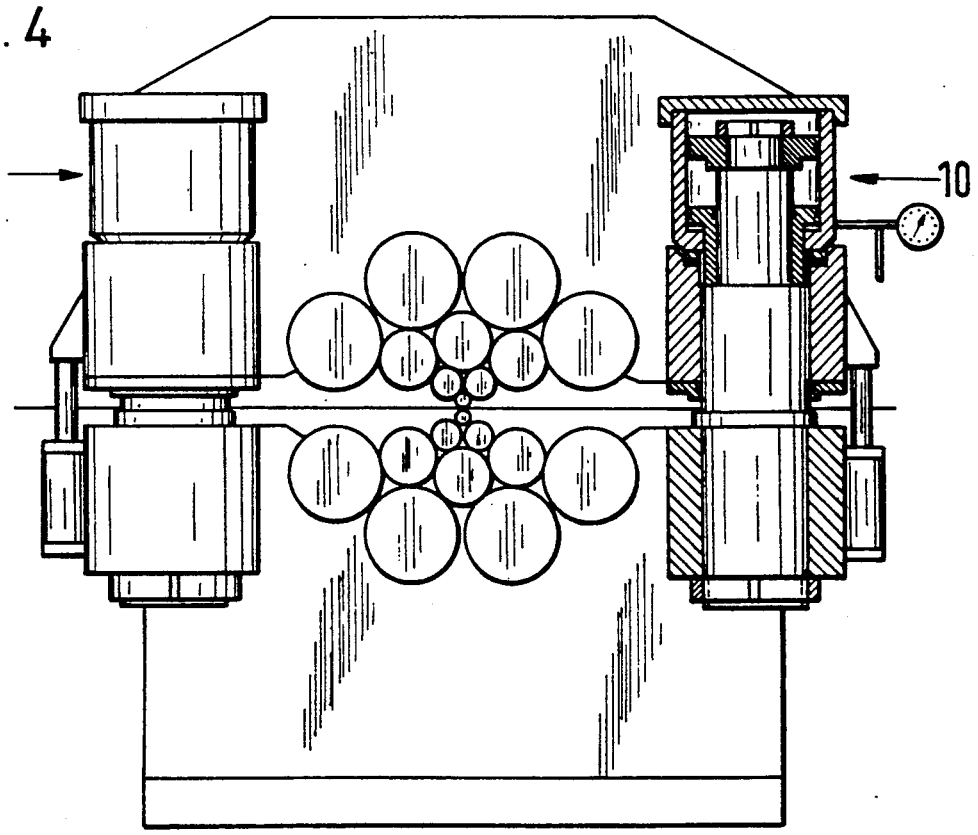
FIG. 4 shows the cluster mill shown in FIG. 2 with the sets of rollers moved together during rolling operation.

In the embodiment illustrated in FIGS. 3 and 4 the column 6 bears fixed thereon a smaller column 6' bearing a piston 19 fixed thereon. Also disposed axially displaceably on the smaller column 6' is a piston 20 which can be acted upon on both sides. The column 6' with its two pistons 19, 20 is disposed in a cylinder casing 21 borne by the upper part 2. The piston 20 has on its underside a sleeve-shaped attachment 22 via which it extends out of the cylinder casing 21.

The lifting devices 11, 12 are actuated to move the upper part out of the position shown in FIG. 3, in which the sleeve-shaped attachment 22 has been lifted with its end remote from the piston 20 off the step of the column 6, into the position shown in FIG. 4. The cylinder space disposed above the piston 20 is acted upon by a relatively high pressure for the adjustment of the rolling pressure. The piston 20 abuts via its sleeve-shaped attachment 22 the step of the column 6 and is thus axially fixed. In the other direction it bears against the piston 19 via the pressure medium in the cylinder chamber. Having regard to the rolling force to be exerted, the pressure in the upper cylinder space must be such that the column 6 in practice forms a rigid unit with the piston 19 and the piston 20. To adjust the rolling force, the pressure medium is admitted into the cylinder space from the underside of the piston 20. The pressure of said pressure medium is low in comparison with the pressure of the pressure medium present in the superjacent cylinder space. In spite of this lower pressure, the screw-down adjustment is rigid, since the height of the cylinder space below the piston 20 is small.

Spacing elements, for example, in the form of rings, can be inserted between the sleeve-shaped attachment 22 of the piston 20 and the step of the column 6, to adjust the roll gap to different heights.

We claim:

1. A cluster mill comprising an upper part having an upper set of rolls and a lower part having a lower set of rolls, a plurality of columns disposed between said upper part and said lower part, said columns being anchored in said lower part, said upper part being guided on said columns, lifting means attached to said upper and lower parts for lifting and lowering said upper part relative to said lower part, hydraulic screw-down means associated with said upper and lower parts for generating a roll force between said upper and lower sets of rolls after said lifting means has moved said upper and lower sets of rolls into an initial operating position, said lifting means being located outside of and operating independently of said hydraulic screw-down means, said hydraulic screw-down means comprising a piston and cylinder arrangement associated with each of said columns, each piston being axially fixed to its associated column in an initial position, each piston and cylinder defining a cylinder space into which hydraulic fluid is introduced to generate said roll force.

2. The cluster mill of claim 1 wherein the height of said cylinder space is less than the distance which said lifting means causes said upper part to travel.

3. The cluster mill of claim 1 further comprising a spindle mounted on said column, said piston being axially fixed to its associated column via said spindle, and adjustment means connected to said spindle for adjusting the initial position of said piston.

4. The cluster mill of claim 1 wherein said piston has two sides, said cluster mill further comprising means for introducing said hydraulic fluid into said cylinder on both sides of said piston, and wherein said piston is axially fixed to its associated column in said initial position by initially introducing said hydraulic fluid on one side only of said piston so that said piston abuts against a top on said column.

5. The cluster mill of claim 4 further comprising spacing elements disposed between said piston and said stop.

* * * * *